US009534831B2

(12) United States Patent
Cur et al.

(10) Patent No.: US 9,534,831 B2
(45) Date of Patent: Jan. 3, 2017

(54) LIQUID DISPENSER WITH COLLAPSIBLE CONTAINER

(75) Inventors: Nihat Cur, Saint Joseph, MI (US); Steven J. Kuehl, Stevensville, MI (US); Robert J. Rolek, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 802 days.

(21) Appl. No.: 12/915,081

(22) Filed: Oct. 29, 2010

(65) Prior Publication Data

US 2012/0104020 A1 May 3, 2012

(51) Int. Cl.

| | |
|---|---|
| ***B65D 35/28*** | (2006.01) |
| ***F25D 23/12*** | (2006.01) |
| ***B67D 1/00*** | (2006.01) |
| ***B67D 1/08*** | (2006.01) |

(52) U.S. Cl.

CPC ..... *F25D 23/126* (2013.01); *B67D 1/0001* (2013.01); *B67D 1/0804* (2013.01); *B67D 2001/0811* (2013.01); *F25D 2323/122* (2013.01)

(58) Field of Classification Search

CPC . B65D 83/0072; B65D 83/0055; B65D 35/28; B65D 33/04; B65D 25/26; B05C 17/00583; A23G 9/28; B67D 2210/00036; B67D 1/0001

USPC ..... 222/95, 105, 386.5, 504, 336, 333, 340, 222/386, 496, 41

See application file for complete search history.

(56) References Cited

U.S. PATENT DOCUMENTS

| | | | | |
|---|---|---|---|---|
| 720,902 | A * | 2/1903 | Brau | 222/95 |
| 2,229,850 | A * | 1/1941 | Hoskins | F25D 23/126 210/235 |
| 2,408,704 | A * | 10/1946 | Taylor | F25D 23/126 222/132 |
| 2,437,589 | A * | 3/1948 | Bink | 222/493 |
| 2,659,517 | A * | 11/1953 | Reinhardt, Jr. | 222/82 |
| 2,970,452 | A * | 2/1961 | Beckman et al. | 62/50.2 |
| 3,734,348 | A * | 5/1973 | White | 222/1 |
| 4,386,716 | A | 6/1983 | Buck | |
| 4,509,659 | A * | 4/1985 | Cloutier et al. | 222/41 |
| 4,645,094 | A * | 2/1987 | Acklin et al. | 222/52 |
| 4,711,373 | A * | 12/1987 | Christine | 222/82 |
| 4,886,189 | A * | 12/1989 | Vanderjagt | 222/49 |
| 4,907,723 | A * | 3/1990 | Katz | 222/105 |
| 5,046,648 | A * | 9/1991 | Herbstzuber | 222/638 |
| 5,048,724 | A * | 9/1991 | Thomas | 222/95 |

(Continued)

FOREIGN PATENT DOCUMENTS

| | | |
|---|---|---|
| WO | 2005/079361 A2 | 9/2005 |
| WO | 2005/079361 A3 | 9/2005 |

(Continued)

*Primary Examiner* — Paul R Durand
*Assistant Examiner* — Charles P Cheyney

(57) ABSTRACT

A liquid dispenser utilizes a collapsible container that contains a supply of liquid. The collapsible container is received within a chamber that has a stationary wall. A moveable member is adjustable into contact with the collapsible container within the chamber. An indicator displays an estimated amount of liquid remaining in the collapsible container based on a position of the moveable member. The moveable member may squeeze the collapsible container against the stationary wall to thereby increase pressure within the liquid in the collapsible container to urge an outlet valve towards an open position in order to resolve any clogs in the valve.

16 Claims, 7 Drawing Sheets

(56) References Cited

U.S. PATENT DOCUMENTS 5,135,646 A * 8/1992 Tanokura et al. ..... 210/109
5,145,083 A * 9/1992 Takahashi ..... 220/203.24
5,158,793 A * 10/1992 Helbling ..... A47J 31/007 426/231
5,377,871 A * 1/1995 Banks et al. ..... 222/41
5,499,758 A * 3/1996 McCann ..... B67D 1/045 222/386.5
5,603,230 A * 2/1997 Tsai ..... B67D 3/0009 62/331
5,620,115 A * 4/1997 McGill ..... 222/95
5,992,685 A * 11/1999 Credle, Jr. ..... 222/1
6,131,766 A * 10/2000 King et al. ..... 222/1
6,131,776 A * 10/2000 De Laforcade et al. ..... 222/387
6,138,693 A * 10/2000 Matz ..... A47L 15/4418 134/100.1
6,264,066 B1 * 7/2001 Vincent et al. ..... 222/95
6,325,244 B2 * 12/2001 Vincent et al. ..... 222/1
6,367,666 B1 * 4/2002 Hou et al. ..... 222/386.5
6,401,977 B1 * 6/2002 Ross, III ..... 222/99
6,641,240 B2 * 11/2003 Hsu et al. ..... 347/7
6,739,478 B2 5/2004 Bach et al.
6,741,180 B2 * 5/2004 Lassota ..... 340/622
6,926,170 B2 * 8/2005 Groesbeck ..... 222/63
7,086,568 B1 * 8/2006 Cheek ..... 222/103
7,150,791 B2 12/2006 Romine
7,350,423 B2 4/2008 Long et al.
7,578,419 B2 8/2009 Greenwald et al.
7,681,760 B2 * 3/2010 Sadamoto et al. ..... 222/95
7,694,849 B1 * 4/2010 Wiesner ..... 222/1
2006/0000851 A1 1/2006 Girard et al.
2006/0016347 A1 1/2006 Girard et al.
2006/0144244 A1 7/2006 Girard et al.
2006/0169719 A1 8/2006 Bui
2006/0255064 A1 * 11/2006 Donaldson ..... 222/95
2008/0173705 A1 7/2008 Girard et al.
2009/0057341 A1 3/2009 Girard et al.
2009/0112149 A1 * 4/2009 Kriesel et al. ..... 604/19
2010/0059544 A1 * 3/2010 Dijkstra et al. ..... 222/95
2012/0074167 A1 * 3/2012 Galvin et al. ..... 222/82
2015/0129611 A1 * 5/2015 Vulpitta ..... B67D 1/0001 222/101
2016/0068380 A1 * 3/2016 Rege ..... B67D 1/0004 222/23

FOREIGN PATENT DOCUMENTS

WO 2007/056097 A2 5/2007
WO 2007/056097 A3 5/2007
WO 2009/058839 A1 5/2009

* cited by examiner

LIQUID DISPENSER WITH COLLAPSIBLE CONTAINER

FIELD OF THE INVENTION

This invention relates generally to methods and structures for dispensing liquid from a collapsible container. More specifically it relates to methods and structures for estimating the amount of liquid remaining within a collapsible container, and for preventing clogs that might impede dispensing of liquid from the collapsible container.

BACKGROUND OF THE INVENTION

Several appliances utilize liquid dispensers. For example, stand alone beverage dispensers and refrigerators may include built-in beverage dispensers. Washing machines, hand soap dispensers and dishwashers may also utilize liquid dispensers to dispense liquid detergents. A class of flexible containers that contain consumables such as flavorant, beverage concentrate, or chemicals such as detergents or soaps have a pump mechanism built into them. The pump mechanism is actuated by an actuator, typically a solenoid, situated on the host appliance. Alternatively, the collapsible containers may include only a built-in valve that is actuated to allow liquid to flow out under the force of gravity or squeezing force applied to the collapsible container. United States Patent Publication No. US2006/0016347 to Girard et al. shows an appliance that includes a collapsible container attached to a pump for providing flavorant to a beverage.

When using such a collapsible container containing a liquid consumable, it can be desirable to know the amount of liquid remaining within the container. Furthermore, between uses, an outlet valve on the container can stick or clog, as residue from the dispensed liquid within the bag dries out and solidifies.

BRIEF SUMMARY OF THE INVENTION

Therefore, it is an object of the present invention according to one embodiment, to provide an apparatus for indicating the amount of liquid remaining within a collapsible container.

It is another object of the present invention to provide an apparatus for unclogging a dispenser of the type that includes a collapsible container attached to a pump.

According to one embodiment the present invention is a household appliance that includes a liquid dispenser of the type that utilizes a collapsible container and a pump attached to the collapsible container. The appliance includes an appliance body, with a chamber formed within the body for receiving a collapsible container. The chamber includes a stationary wall. A moveable member is adjustable into contact with the collapsible container within the chamber. A biasing member urges the moveable member against the collapsible container with the collapsible container squeezed between the moveable member and the stationary wall. An indicator displays an estimated amount of liquid remaining in the collapsible container based on a position of the moveable member.

According to another embodiment, the present invention is directed to a household appliance that includes a liquid dispenser including a collapsible container containing a liquid, an outlet valve, an actuator for opening the outlet valve and a pump for pumping a portion of the liquid through the open valve. The appliance also includes a stationary wall and a moveable member that is adjustable into contact with a first side of the collapsible container. A biasing element selectively urges the moveable member towards the stationary wall to thereby squeeze the collapsible container between the moveable member and the stationary wall.

According to another embodiment, the present invention is directed to a method of estimating liquid volume within a collapsible container. A collapsible container that contains a liquid concentrate is placed within a chamber that has a stationary wall. A moveable member is pressed against the container to squeeze the container against the stationary wall. An estimated volume of liquid remaining in the container is indicated based on a distance between the moveable member and the stationary wall.

According to yet another embodiment, the present invention is directed to a method of dispensing liquid concentrate in a household appliance. A collapsible container containing liquid concentrate is provided within a chamber formed in the appliance. The chamber includes a stationary wall. A moveable member is pressed against the container to squeeze the container against the stationary wall to thereby create sufficient pressure to unclog an outlet valve. Liquid concentrate is dispensed through the unclogged valve using a pump.

DETAILED DESCRIPTION OF PREFERRED EMBODIMENTS

Figure 1:
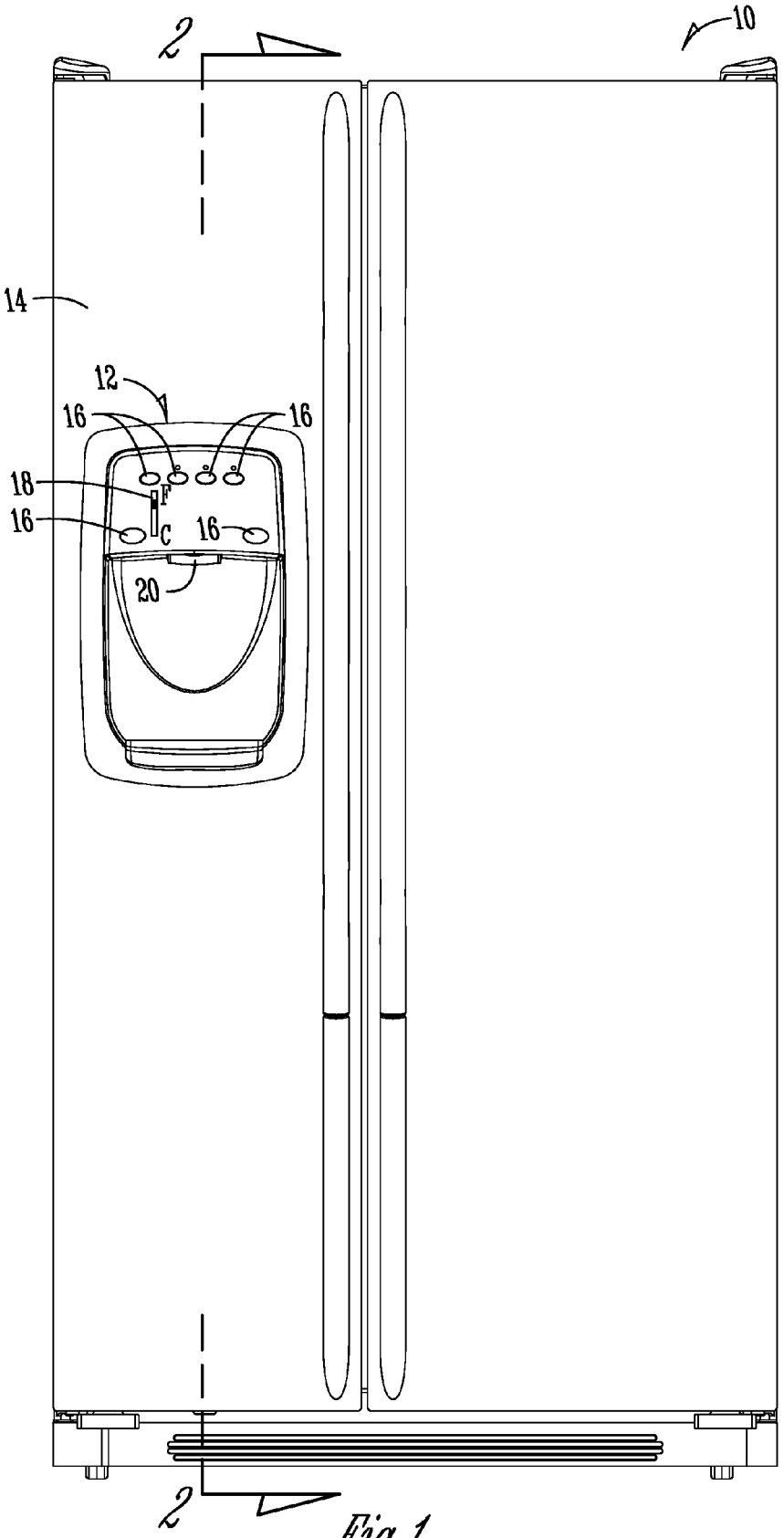
FIG. 1 is a front view of an appliance according to one embodiment of the present invention.

FIG. 1 is a front elevation view of an appliance 10 according to one embodiment of the present invention that includes a liquid dispenser. In the embodiment shown, the appliance 10 is a household refrigerator. However, appliance 10 may be any household appliance that includes a liquid dispenser that utilizes a collapsible container for containing the supply of liquid. For example, the appliance 10 might be a beverage dispenser that utilizes a collapsible container containing flavorant for providing flavored beverages. Alternatively, the appliance 10 might be a dishwasher that utilizes a collapsible container containing dishwashing soap. Appliance 10 might be a clothes washing machine that utilizes a collapsible container containing laundry detergent. Those of skill in the art may be aware of other household appliances in which the presently described invention will be useful.

The refrigerator 10 of FIG. 1 has a dispenser housing 12 mounted on a refrigerator door 14. Control buttons 16 are provided to permit control of various functions of the dispenser. A liquid gauge 18 indicates an estimated volume of liquid remaining in the collapsible container. The liquid gauge 18 is shown as a vertical gauge with a full indicator at the top of the gauge and an empty indicator at the bottom of the gauge. The gauge 18 might also be a dial style gauge, or could be a digital output.

A dispenser outlet 20 provides an outlet through which a beverage can be dispensed. The outlet 20 may include one or more nozzles for dispensing water and flavorant. The outlet 20 may also include an outlet for dispensing ice.

Figure 2:
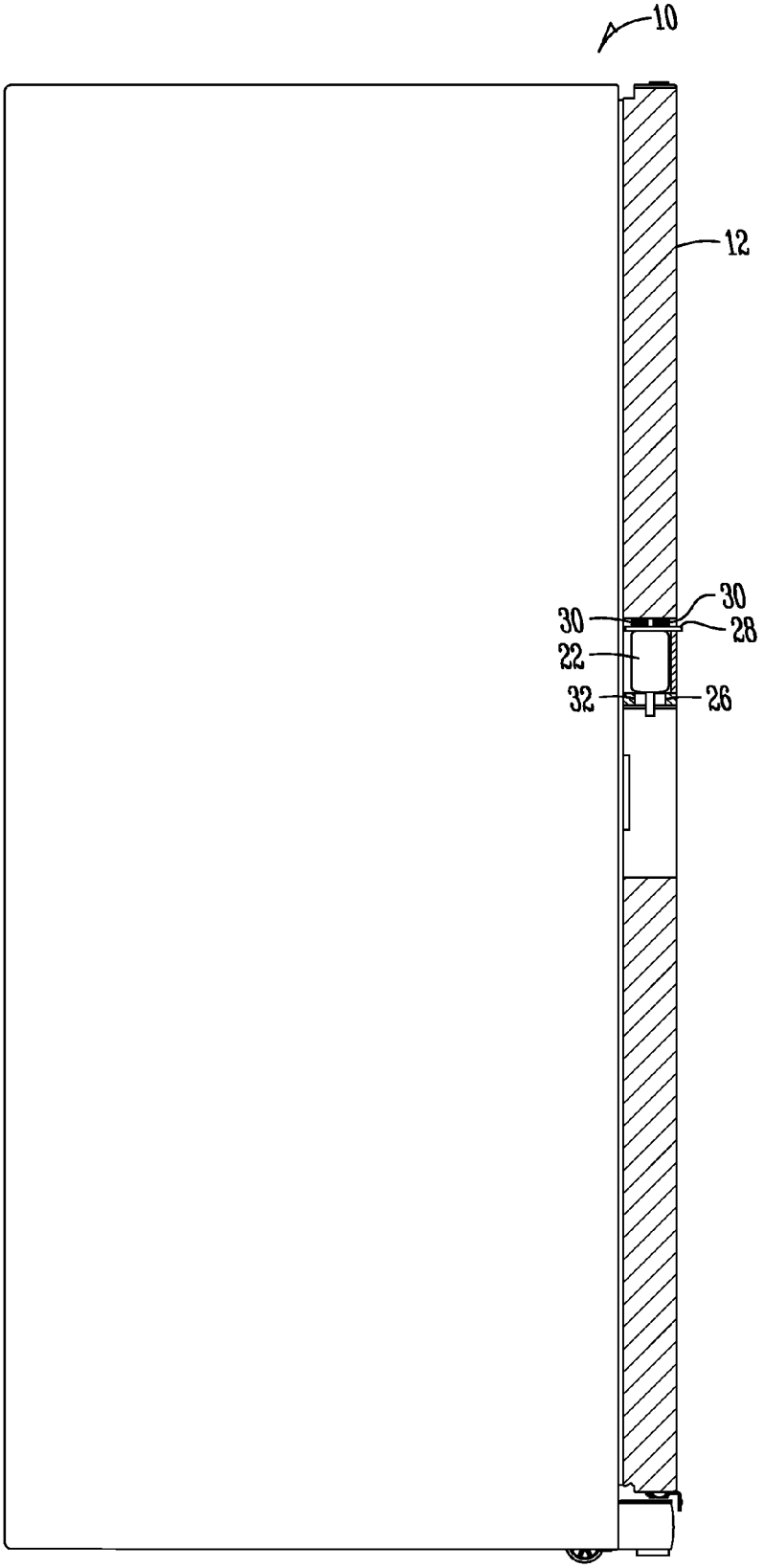
FIG. 2 is a partial cross-sectional side view of the appliance including a liquid dispenser with a collapsible container according to one embodiment of the present invention.

FIG. 2 shows a cross-sectional view of the door 14 of the appliance 10. A collapsible container 22 is provided within a chamber 24 formed in the door 14. In the embodiment shown, the collapsible container 22 will preferably contain a concentrated flavorant that can be mixed with water to form a flavored beverage. Alternatively, the collapsible container 22 might contain a pre-mixed beverage that does not need to be diluted with water. The collapsible container 22 rests against a stationary bottom wall 26. A moveable member 28 is in contact with the top of the collapsible container 22. As the amount of liquid remaining within the collapsible container 22 reduces, the top of the collapsible container 22 will collapse towards the stationary bottom wall 26. The moveable member 28 is held in contact with the top of the collapsible container 22 by biasing elements 30. Therefore when the collapsible container 22 is full, the moveable member 28 is located near the top chamber 24. As liquid is removed from the collapsible container 22 and the collapsible container 22 collapses downwardly towards the stationary bottom wall 26, the moveable member 28 also moves downward towards the stationary bottom wall 26. A portion of the moveable member 28 is visible to users, such that users receive a visual indication of approximately how much liquid is remaining in the collapsible container 22. The biasing elements 30 may be something simple such as springs or other resilient members, or may be more complicated structures, such as a motor or motors or solenoids. The collapsible container 22 may be associated with a pump and valve mechanism 32 for controlling the dispensing of liquid from the collapsible container 22.

Figure 3A:
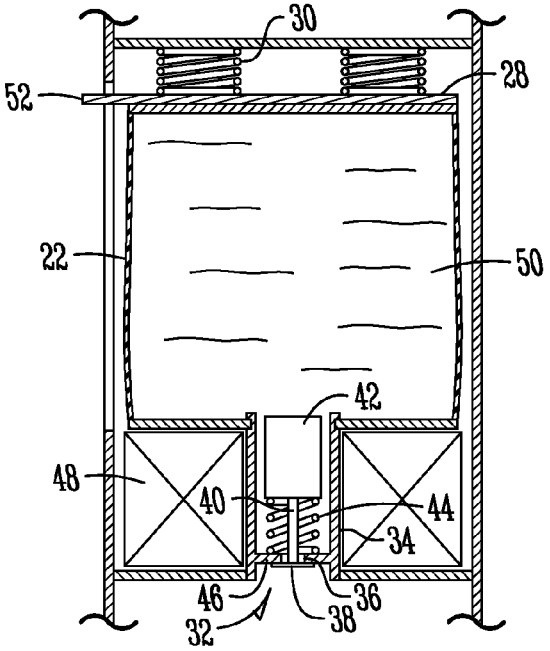
FIG. 3A is a cross-sectional detail view of a liquid dispenser that includes a collapsible container and a moveable member for estimating an amount of liquid remaining in the container.
Figure 3B:
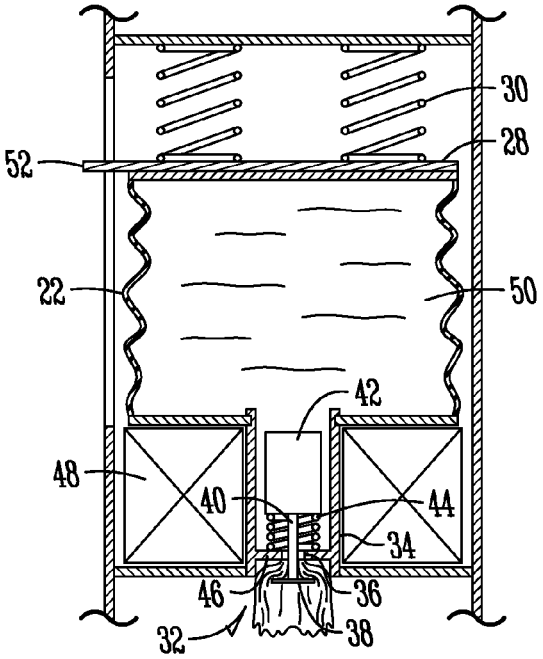
FIG. 3B is a detail cross-section view of a liquid container of FIG. 3A indicating a smaller amount of liquid remaining within the collapsible container.

According to the embodiment shown in FIGS. 3A and 3B the pump and valve mechanism 32 includes an outlet spout 34 that is affixed to the collapsible container 22. The outlet spout 34 is open to receive liquid from the collapsible container 22 in an upper end of the outlet spout 34. At a lower end of the outlet spout 34 is an outlet aperture 36. The outlet aperture 36 is normally closed by valve head 38. A valve rod 40 extends through the outlet aperture 36 and connects the valve head 38 with a pump head 42. The valve head 38 is retained in the closed position that seals outlet aperture 36 by a spring 44 that presses between shoulder 46 and the pump head 42. Either the pump head 42 or the valve rod 40, or both, may be formed from a ferrous material. A magnetic field generator 48 surrounds the outlet spout 34. The magnetic field generator 48 may be an electric coil. When the magnetic field generator 48 is activated, such as by passing an electric current through an electric coil, the magnetic force generated will cause the pump head 42 and rod 40 to be pulled downwardly such that the valve head 38 is unseated from the shoulder 46 to permit the liquid 50 within the collapsible container 22 to flow outwardly through the outlet aperture 36.

The moveable member 28 rests on top of the collapsible container 22. A portion of the moveable member 28 is visible outside of the chamber 26, such that it acts as a volume indicator 52. In FIG. 3A the collapsible container 22 is full, or nearly full, of liquid 50. Accordingly, the moveable member 28, which sits on top of the collapsible container 22, is near the top of the chamber 26, such that the volume indicator 52 is at the top of the liquid gauge 18 to indicate to a user that the collapsible container 22 is nearly full. In FIG. 3B, some of the liquid 50 has been dispensed from the collapsible container 22, such that the collapsible container 22 is only partially full. Accordingly, the moveable member 28, which rests on top of the collapsible container 22, has been lowered towards the stationary wall 26 of the bottom of the chamber 24. The volume indicator 52 is therefore at an intermediate position within the liquid gauge 18 indicating that the collapsible container 22 is partially filled with liquid 50, permitting a user to estimate about how much liquid remains. The springs, which act as biasing elements 30, retain the moveable member 28 in close contact with the top of the collapsible container 22, such that as the collapsible container 22 empties, the moveable member 28 remains in contact with the collapsible container 22.

The pump and valve mechanism 32 shown in FIGS. 3A and 3B is of the same type as shown and described in Greenwald, U.S. Pat. No. 7,578,419; Girard, U.S. Patent Publication No. 2006/0000851; and Girard, U.S. Patent Publication No. 2008/0173705; all of which are hereby incorporated by reference in their entireties. Those of skill in the art may be aware of other valve and pump mechanisms that can be used to dispense liquid from a collapsible container in order to take advantage of the present invention. For example, the present invention would be beneficially used with collapsible containers that rely on gravity flow or pressurizing of the container, rather than a pump mechanism.

Figure 4A:
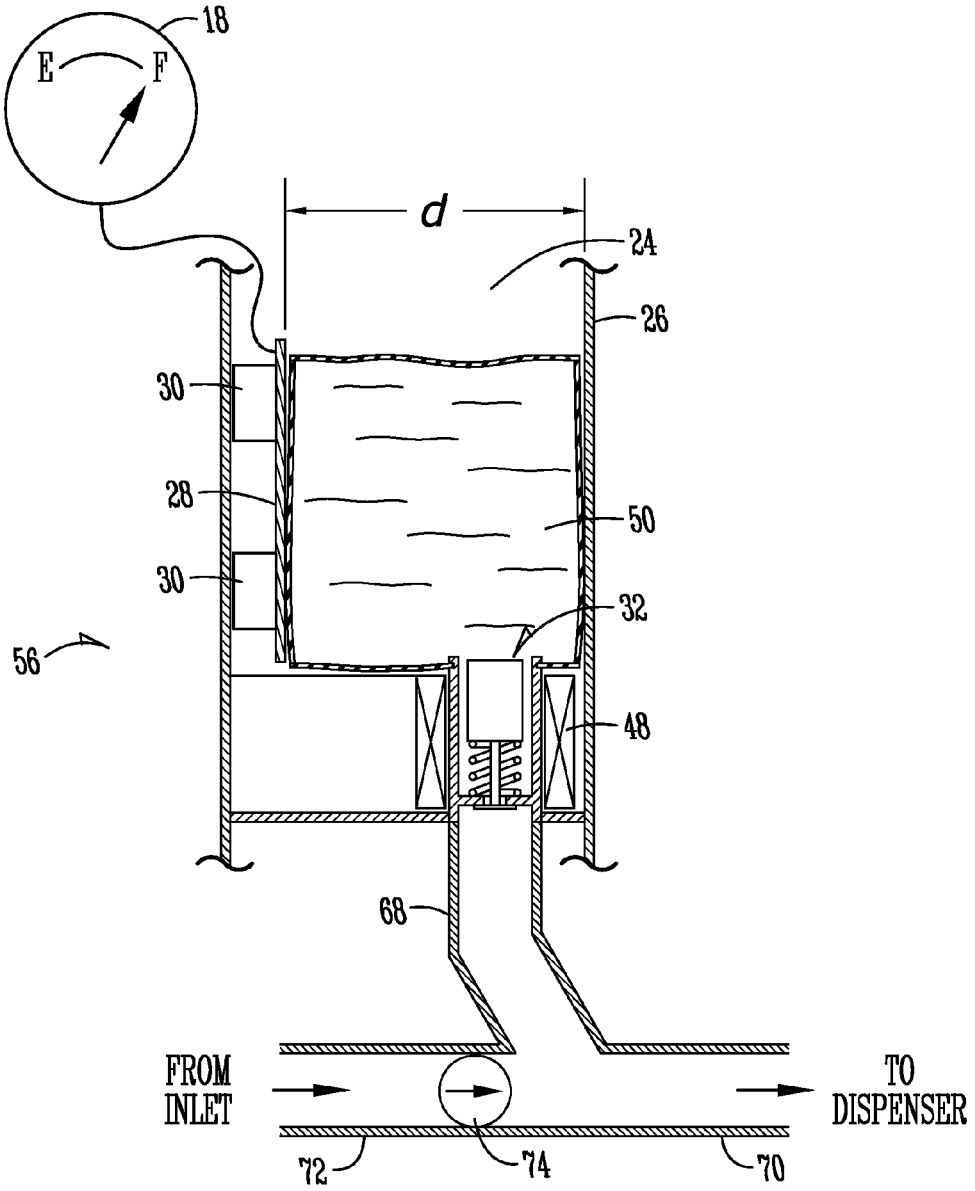
FIG. 4A is a partial cross-section detail view of a liquid dispenser including a collapsible container and a mechanism for estimating the liquid remaining in the collapsible container according to another embodiment of the present invention.
Figure 4B:
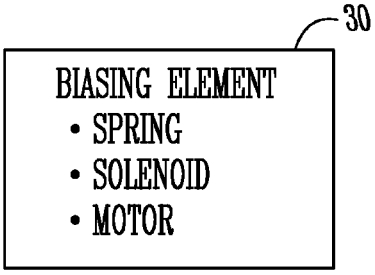
FIG. 4B shows a schematic of the biasing elements of FIG. 4A.

FIG. 4 shows an embodiment of an appliance liquid dispenser 56 according to another embodiment of the present invention. The appliance liquid dispenser 56 includes a chamber 24 with a stationary side wall 26. A moveable member 28 is provided that is biased towards the stationary wall 26 by biasing elements 30. The biasing elements 30 maintain the moveable member 28 in contact with a side of the collapsible container 22 that is opposite from the stationary wall 26. As the collapsible container 22 dispenses liquid 50 and empties, the moveable member 28 approaches the stationary wall 26. The moveable member 28 is associated with a gauge 18 that indicates an estimated amount of liquid remaining in the collapsible container 22. Therefore, if the distance (d) between the moveable member 28 and the stationary wall 26 is relatively large, the gauge 18 will indicate that the collapsible container is nearly full. As the distance (d) approaches zero, the gauge 18 approaches an indication of empty. The appliance dispenser 56 of FIG. 4 is provided with an outlet conduit 68 that connects with a dispenser conduit 70. The dispenser conduit 70 is connected with a water conduit 72. Therefore, the liquid 50 within the collapsible container may be mixed with the water in the water conduit 72 to be dispensed from the dispenser conduit 70 as a mixture. For example, the mixture may be a flavored beverage, or may be a mixture of soap and water. The water conduit 72 is provided with a valve 74 for selectively controlling the flow of water.

Figure 5:
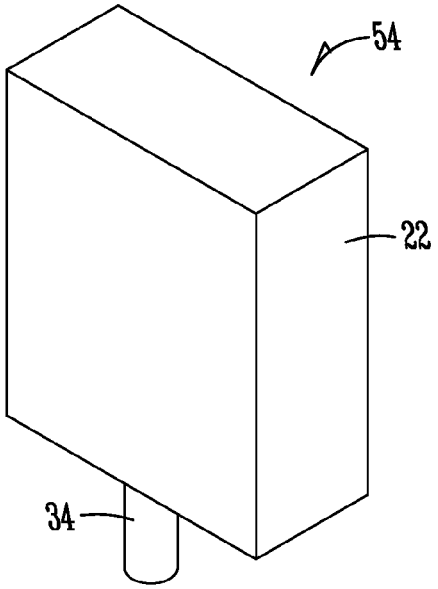
FIG. 5 is a perspective view of an embodiment of a collapsible container for use in the present invention.

FIG. 5 shows an isometric view of a disposable cartridge 54 that is suitable for use within the present invention. The disposable cartridge 54 includes a collapsible container portion 22 that is sealed in fluid communication with an outlet spout 34.

Figure 6:
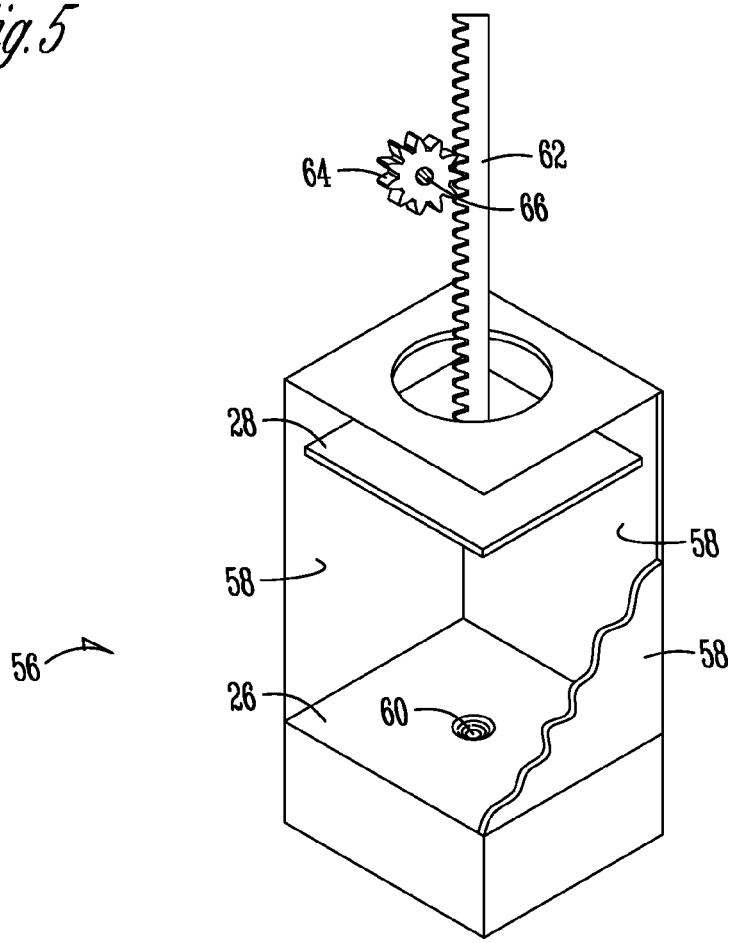
FIG. 6 is a cut-away perspective view of a chamber according to one embodiment of the present invention for use in estimating the amount of liquid remaining within a collapsible container and for clearing any clogs within a valve attached to the collapsible container.

FIG. 6 shows an appliance liquid dispenser 56 in which the disposable cartridge 54 may be used. The appliance liquid dispense 56 includes a chamber 24 formed by side walls 58. A stationary bottom wall 26 includes an opening 60 for receiving the outlet spout 34 of the disposable cartridge 54 when it is inserted into the chamber 24 in a working position. A moveable member 28, in the form of a plate, is attached to a rack 62. The rack 62 is moveable up and down by a pinion gear 64 that is driven by a motor or similar device. Therefore, the motor, pinion gear 64, and rack 62 acts together as a biasing element to bias the moveable member 28 up and down.

Figure 7A:
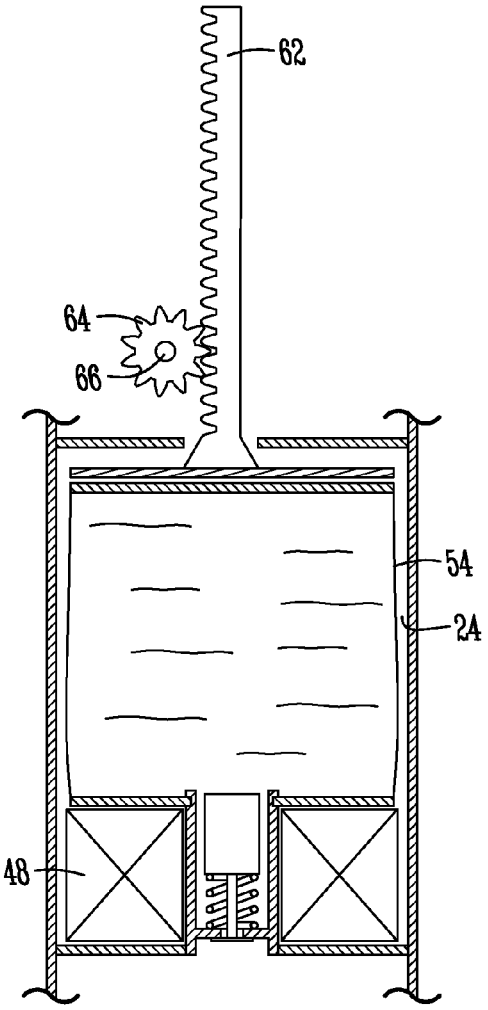
FIG. 7A shows a cross-sectional view of the chamber of FIG. 6 with a full collapsible container in place within the chamber.
Figure 7B:
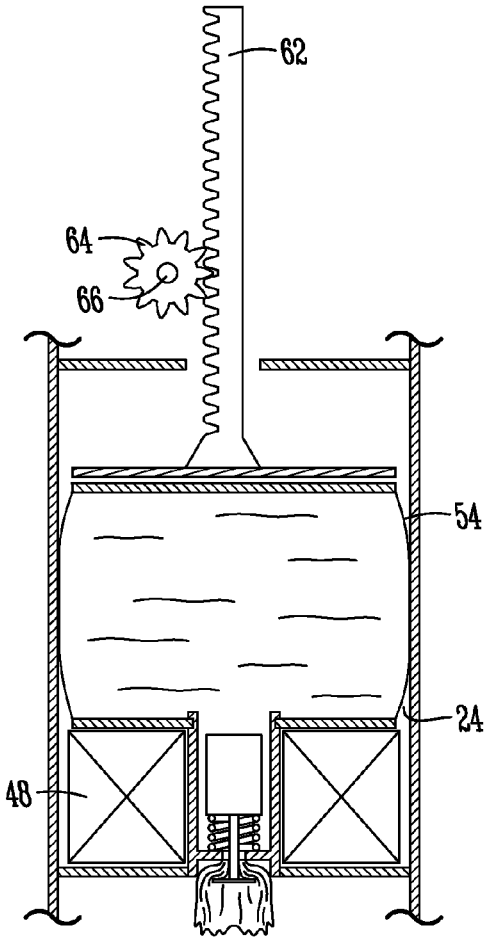
FIG. 7B is a cross-sectional view of the chamber of FIG. 7A while the dispenser is dispensing liquid.

FIGS. 7A and 7B show the appliance liquid dispenser 56 from FIG. 6 in cross-sectional view with a disposable cartridge 54 inserted. In FIG. 7A, the collapsible container 22 of the disposable cartridge 54 is full. The moveable member 28 is near the top of the chamber 24. The rack 62 is lifted to nearly its highest position. The rack 62 itself may serve as a visual indicator of the volume of liquid remaining within the container 22. Alternatively, a position sensor may be utilized in conjunction with the rack 62 or the moveable member 28 to send a signal to a gauge 18 that indicates approximately how much liquid remains in the collapsible container 22 dependent upon the position of the rack 62 or the moveable member 28. As a further alternative, a sensor may be connected with the pinion gear 64 to sense an angular position of the pinion gear and thereby sense the position of the moveable plates 28, which a proxy for the amount of liquid remaining within the collapsible container 22.

The pump and valve mechanism is similar to that shown in FIGS. 3A and 3B. On occasion, liquid can dry and harden at the interface between the valve head 38 and the shoulder 46. This causes the valve head 38 to adhere to the shoulder 46 which can form a clog or blockage of the outlet aperture 36. In order to help resolve this blockage, the biasing mechanism, in the case of FIGS. 7A and 7B, the rack and pinion 62 and 64, can be activated to move the moveable member 28 towards the stationary bottom wall 26 in order to squeeze the collapsible container 22 between the moveable member 28 and the stationary bottom wall 26. This squeezing of the collapsible container 22 increases the liquid pressure within the collapsible container 22, which thereby pushes outward against the valve head 38 which tends to break the valve head 38 free from the shoulder 46. Those of ordinary skill in the art will be aware of other biasing mechanisms for applying a force to the moveable member 28 to thereby increase the pressure within the collapsible container 22 to help resolve any blockage of the outlet aperture 36. It may be necessary to apply the squeezing force only at the initiation of a dispensing cycle in order to resolve any blockages. The actual dispensing of liquid through the outlet aperture is primarily accomplished by sequentially activating the magnetic field generator 48 causing the valve rod 40 and pump head 42 to reciprocate up and down in order to pump liquid through the outlet aperture 36.

In FIG. 7B the magnetic field generator 48 has been activated, causing the valve rod 40 and pump head 42 to be pulled downwardly to open the outlet aperture 36 and cause liquid to be dispensed from the collapsible container 22. The collapsible container 22 has been partially emptied, and therefore the top of the collapsible container 22 has collapsed towards the bottom stationary wall 26. The moveable member 28 is maintained in contact with the top of the collapsible container 22 by the biasing mechanism of the motor 66 and pinion gear 64 acting against the rack 62. The amount of liquid remaining within the collapsible container 22 can then be estimated by an inspection of the position of the rack 62. Alternatively, as noted above, a position sensor may be associated with the rack 62 or the moveable member 28 to provide a signal to a gauge based on the position of the moveable member 28. Accordingly, the embodiment shown in FIGS. 6 and 7A-7B is adapted to use the moveable member 28 both to help resolve clogs, and to estimate the amount of liquid remaining within the collapsible container 22.

Figure 8:
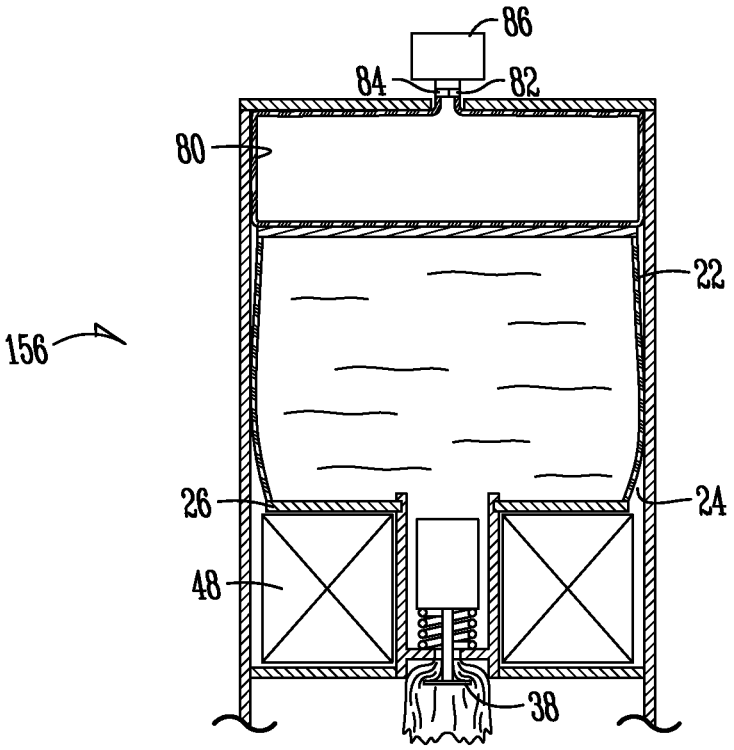
FIG. 8 is a partial cross-sectional detail view of a liquid dispenser for dispensing liquid from a collapsible container wherein the dispenser includes a bladder for pressing against the collapsible container.

FIG. 8 shows an embodiment of an appliance liquid dispenser 156 according to another embodiment of the present invention. According to this embodiment, an inflatable bladder 80 is used to press against the collapsible container 22, as seen in FIG. 8. The collapsible container 22 is provided within a chamber 24 formed within an appliance that includes at least one stationary wall 26. The inflatable bladder 80 is also provided within the chamber 24 such that as the bladder 80 is inflated, for example with air or other gas, it squeezes the collapsible container 22 against stationary wall 26. According to one embodiment, the bladder 80 contains a constant amount of gas within it. Therefore, the pressure and temperature of the gas within the bladder 80 can be measured to estimate a volume occupied by the gas in the bladder, which is directly related to the amount of liquid remaining within collapsible container 22. A pressure transducer 82 and temperature sensor 84 may be included in this embodiment. In some embodiments, the temperature of the bladder 80 may remain relatively constant, such that it is unnecessary to include a temperature sensor. The sensors (82 and 84) may be connected with a processor that utilizes signals received from the sensors 82 and 84 to calculate an estimated amount of liquid remaining in the collapsible container 22. The processor can then send a signal to a gauge that displays an indication of the amount of liquid remaining.

The dispenser 156 may also be provided both on pump 86 in order to pressurize gas from the bladder 80. The pump 86 may be energized to pressurize the bladder 80 upon the initiation of a dispensing cycle in order to pressurize the liquid within the collapsible container 22 to provide an additional force against the valve head 38 that urges the valve head 38 to the open configuration shown in FIG. 8, in order to help resolve any clogs at the initiation of the dispensing cycle. A release valve (not shown) may also be provided to release gas and reduce pressure in the bladder 80.

The invention has been shown and described with reference to the preferred embodiments. It should be understood that many modifications, substitutions, and additions may be made that are within the intended scope and spirit of the invention. The invention is only limited by the claims that follow.

What is claimed is:

1. A household appliance including a liquid dispenser of the type that utilizes a collapsible container and a pump and valve mechanism attached to the collapsible container, the appliance comprising:

a household appliance body having a door;

a chamber formed within the door of the body for receiving a collapsible container, the chamber including a stationary wall;

a movable member resting on top of the collapsible container within the chamber;

a biasing element that urges the movable member against the collapsible container with the collapsible container between the movable member and the stationary wall;

a liquid gauge for displaying an estimated amount of liquid remaining in the collapsible container based on a position of the movable member and a signal received from a processor;

a volume indicator, said volume indicator being an extension of the movable member, and further providing that a portion of the volume indicator is visible outside the door; and a position sensor that senses the position of the movable member and sends a signal to the processor for estimating the amount of liquid remaining in the collapsible container; and wherein the pump and valve mechanism is positioned at least partially in the collapsible container and selectively actionable to allow a liquid of the collapsible container to be dispensed via the liquid dispenser.

2. The household appliance of claim 1, wherein the biasing element is a spring, wherein the biasing element is in a compressed state when the collapsible container is full with the liquid.

3. The household appliance of claim 1, wherein the biasing element is a motor.

4. The household appliance of claim 1, wherein the biasing element is a supply of pressurized gas provided within an inflatable bladder, said bladder containing a constant amount of gas within.

5. A household appliance comprising:

a liquid dispenser including a collapsible container containing a liquid, an outlet, a valve head at least partially disposed in the collapsible container for selectively closing and opening the outlet, and an actuator for moving the valve head, said collapsible container provided within a chamber formed in a door of the appliance;

a stationary wall;

a movable member that is adjustable into contact with a first side of the collapsible container, said indicator being an extension of the movable member, and further providing that a portion of the indicator is extending outside the door;

said indicator providing a visual display of an estimated amount of liquid remaining in the collapsible container based upon a position of the movable member;

a biasing element that selectively urges the movable member towards the stationary wall when activated to thereby squeeze the collapsible container between the movable member and the stationary wall and thereby increase pressure within the liquid in the collapsible container to urge the valve head towards an open position; and a position sensor that senses the position of the movable member and sends a signal, via a processor, to an indicator for displaying the amount of liquid remaining in the collapsible container.

6. The household appliance of claim 5, wherein the biasing element is controllable to be activated for a short period of time upon initiation of a dispensing event to resolve any clogs in the outlet.

7. The household appliance of claim 5, wherein the collapsible container is a disposable cartridge that includes a valve and pump mechanism for pumping a portion of the liquid through the opened outlet.

8. The appliance of claim 5, wherein the appliance is a refrigerator, and the liquid is a concentrated flavorant for mixing with water to form a flavored beverage.

9. A method of estimating liquid volume within a collapsible container comprising:

providing a household container that includes a chamber having a stationary wall;

providing a collapsible container that contains a liquid within the chamber, said chamber formed in a door of an appliance;

pressing against the container with a movable member to squeeze the container against the stationary wall;

generating a volume estimation, via visualization of an indicator extending from the movable member and further extending outside of the container, of liquid remaining in the collapsible container;

generating a volume estimation, via a processor, of liquid remaining in the collapsible container based on a position of the movable member via a position sensor;

displaying the volume estimation received from the processor;

dispensing an amount of liquid via a selectively actionable valve and pump mechanism; and repeating the step of indicating an estimated volume based upon the change in position of the movable member due to the amount of liquid dispensed;

and further including an extension outside of the door of the appliance.

10. The method of claim 9, wherein the collapsible container is a disposable container that includes an outlet aperture and a valve head, the valve head being adjustable between an open position and a closed position relative to the outlet aperture, wherein the disposable container further includes a pump head for pumping a portion of the liquid through the outlet aperture; and further wherein the appliance includes an actuator for actuating and driving the pump head.

11. The method of claim 10, wherein the appliance is a household refrigerator and the liquid is a flavorant concentrate for mixing with water to form a flavored beverage to be dispensed from the refrigerator.

12. The method of claim 10, further comprising:

resolving clogs by squeezing the collapsible container against the stationary wall with the movable member with sufficient force to move the valve head to the open position;

dispensing a portion of the liquid by activating the actuator; and terminating the resolving step while continuing the dispensing step.

13. The method of claim 12, further comprising mixing the dispensed portion of the liquid with water to form a flavored beverage.

14. A method of dispensing liquid in a household appliance, the method comprising:

providing a collapsible container that contains a liquid within a chamber formed in a door of the appliance, the chamber having a stationary wall;

pressing against the container with a movable member to squeeze the container against the stationary wall to thereby create sufficient pressure in the liquid to unclog an outlet aperture;

dispensing liquid concentrate through the unclogged outlet aperture using a pump and valve mechanism in which the pump and valve are selectively activated by a magnetic field to provide an outlet of the container;

providing a gauge to display an electronic signal from a processor of an amount of liquid remains in the collapsible container;

providing a connection between the gauge and the movable member such that the indication depends on a position of the movable member;

providing a position sensor that senses the position of the movable member and sends a signal to the gauge via the processor for estimating how much liquid remains in the collapsible container; and providing an indicator extending from the movable member and further extending outside of the door to further allow visual estimation of how much liquid remains in the collapsible container.

15. The method of claim 14, wherein the connection is a mechanical connection.

16. The method of claim 14, wherein the connection is an electrical connection.

* * * * *